US012747072B2

(12) United States Patent
Cheng

(10) Patent No.: US 12,747,072 B2
(45) Date of Patent: Sep. 29, 2026

(54) LID ASSEMBLY FOR A CONTAINER

(71) Applicant: Kwan Ming Cheng, Hong Kong (HK)

(72) Inventor: Kwan Ming Cheng, Hong Kong (HK)

( * ) Notice: Subject to any disclaimer, the term of this patent is extended or adjusted under 35 U.S.C. 154(b) by 94 days.

(21) Appl. No.: 18/976,188

(22) Filed: Dec. 10, 2024

(65) Prior Publication Data

US 2025/0250073 A1 Aug. 7, 2025

Related U.S. Application Data

(60) Provisional application No. 63/549,566, filed on Feb. 4, 2024.

(51) Int. Cl.
*B65D 47/06* (2006.01)

(52) U.S. Cl.
CPC ..... *B65D 47/063* (2013.01); *B65D 47/066* (2013.01); *B65D 47/061* (2013.01); *B65D 47/065* (2013.01)

(58) Field of Classification Search
CPC ..... B65D 47/063; B65D 43/0214; B65D 47/066; B65D 47/065; B65D 47/08; B65D 47/06; B65D 47/061; B65D 47/0819; B65D 47/0804; B65D 47/0809; A47G 19/2266; A47G 19/2272
USPC ..... 222/566, 567, 548, 556, 557; 220/708, 220/715, 254.3, 254.4, 254.7, 254.9
See application file for complete search history.

(56) References Cited

U.S. PATENT DOCUMENTS

| | | | |
|---|---|---|---|
| 9,585,803 | B2 | 3/2017 | Niedens |
| 10,683,146 | B2 | 6/2020 | Farsai et al. |
| 11,345,524 | B2 | 5/2022 | Ni |
| 11,535,431 | B2 | 12/2022 | Wong et al. |

*Primary Examiner* — David J Walczak
(74) *Attorney, Agent, or Firm* — Muncy, Geissler, Olds & Lowe, P.C.

(57) ABSTRACT

A lid assembly for a container includes a frame; a lid button configured to receive an actuation force thereto and transmit the actuation force in a first direction; a push member having a first end, a second end and a slide surface having an inclination angle wherein the push member is operatively coupled to the lid button on the first end; a guide member having a guide surface and a feeder end wherein the guide surface and the slide surface are adapted to slide over each other; a spout configured to be operatively coupled with a rotary cam disc; and a retractable push-button mechanism operatively coupled to the second end of the push member wherein the retractable push-button mechanism is configured to switch between an engaged state and a disengaged state upon receiving the actuation force in the first direction from the push member.

9 Claims, 5 Drawing Sheets

LID ASSEMBLY FOR A CONTAINER

CROSS REFERENCE TO RELATED APPLICATIONS

This application claims priority of U.S. Provisional Application No. 63/549,566 filed on Feb. 4, 2024 under 35 U.S.C. § 119(e), the entire contents of all of which are hereby incorporated by reference.

FIELD OF INVENTION

The present invention relates to a device for a container. More specifically, the present invention relates to a closure/lid for a container.

BACKGROUND OF INVENTION

The container lid design has evolved to incorporate features for enhancing convenience, functionality, and hygiene. However, the conventional container lid design requires the users to touch the spout to open and close it, which may leave the spout unclean and unhygienic for the next use. Also, the operation of such container lid design is not fully one-handed and may require the users to use both hands for opening and/or closing the spout.

Accordingly, there is a need for an improved lid for opening and closing a container without touching the spout with one hand operation.

SUMMARY OF INVENTION

In light of the foregoing background, in certain embodiments, it is an object of the present invention to provide a lid assembly for a container.

Accordingly, the present invention provides a frame; a lid button configured to receive an actuation force thereto and transmit the actuation force in a first direction; a push member having a first end, a second end and a slide surface having an inclination angle wherein the push member is operatively coupled to the lid button on the first end and configured to receive the actuation force in the first direction from the lid button; a guide member having a guide surface and a feeder end wherein the guide surface and the slide surface are adapted to slide over each other such that when the push member receives the actuation force from the lid button, the push member drives the guide member towards a second direction according to the inclination angle and transmit a cam force in the second direction; a spout configured to be operatively coupled with a rotary cam disc such that the spout and the rotary cam disc rotate around a cam axis together when the rotary cam disc receives the cam force in the second direction from the feeder end of the guide member; and a retractable push-button mechanism operatively coupled to the second end of the push member wherein the retractable push-button mechanism is configured to switch between an engaged state and a disengaged state upon receiving the actuation force in the first direction from the push member; wherein in the disengaged state, the spout is configured to be in an open configuration wherein in the engaged state, the spout is configured to be in a closed configuration.

In some embodiments, the lid assembly further comprises a lid cover having a first curved surface internally disposed on the lid cover, wherein the lid over is removably attached to the frame.

In some embodiments, the rotary cam disc comprises a protrusion having a second curved surface and a cam end, wherein the cam end is configured to be operatively coupled to the feeder end of the guide member and receive the cam force in the second direction from the feeder end of the guide member.

In some embodiments, when the cam end of the protrusion receives the cam force in the second direction from the feeder end of the guide member, the rotary cam disc rotates around the cam axis guided by the first curved surface of the lid cover and the second curved surface of the protrusion.

In some embodiments, the spout comprises a soft tubing unit adapted to be bent when the soft tubing unit is restrained in the closed configuration, the soft tubing unit adapted to be straight in the open configuration.

In another embodiment, the soft tubing unit is made of a resilient material such that the soft tubing unit is configured to be straight at rest and automatically or elastically return to the open configuration from the closed configuration, unless otherwise restrained.

In some embodiments, the retractable push-button mechanism comprises a biasing member operatively coupled to the push member, wherein the biasing member is configured to be compressed when the biasing member receives the actuation force from the push member and the retractable push-button mechanism switches to the engaged state, wherein the biasing member is configured to push the push member distally in a direction opposite to the first direction and become uncompressed when the retractable push-button mechanism switches to the disengaged state.

In another embodiment, the retractable push-button mechanism holds a position of the push member when the retractable push-button mechanism is in the engaged state.

In some embodiments, the guide member further comprises a hinge end configured to be pivotally connected to a hinge formed on the frame, wherein the hinge is configured to allow a pivotal movement of the guide member with respect to the frame such that the guide member transmits the cam force in the second direction.

Other example embodiments will be described below.

There are many advantages of the present disclosure. In certain embodiments, the provided devices achieve one-hand operation with a single button for both opening and closing the spout without touching it.

DETAILED DESCRIPTION

Definitions

Figure 1A:
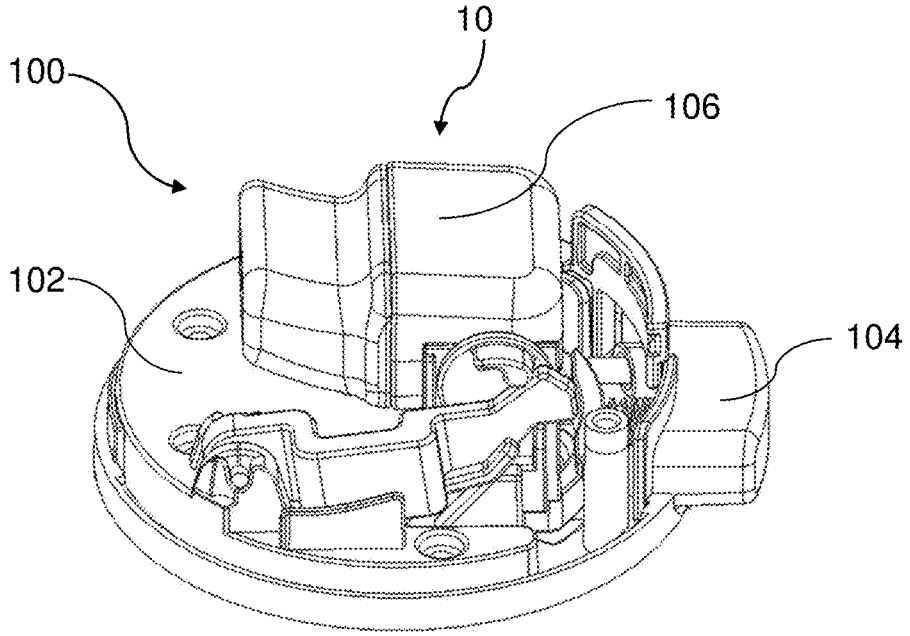
FIG. 1A is a perspective view of the lid assembly in the closed configuration of the spout, according to an example embodiment.

As used herein and in the claims, the terms "comprising" (or any related form such as "comprise" and "comprises"), "including" (or any related forms such as "include" or "includes"), "containing" (or any related forms such as "contain" or "contains"), means including the following elements but not excluding others. It shall be understood that for every embodiment in which the term "comprising" (or any related form such as "comprise" and "comprises"), "including" (or any related forms such as "include" or "includes"), or "containing" (or any related forms such as "contain" or "contains") is used, this disclosure/application also includes alternate embodiments where the term "comprising", "including," or "containing," is replaced with "consisting essentially of" or "consisting of". These alternate embodiments that use "consisting of" or "consisting essentially of" are understood to be narrower embodiments of the "comprising", "including," or "containing," embodiments.

For the sake of clarity, "comprising", "including", "containing" and "having", and any related forms are open-ended terms which allow for additional elements or features beyond the named essential elements, whereas "consisting of" is a closed end term that is limited to the elements recited in the claim and excludes any element, step, or ingredient not specified in the claim.

As used herein and in the claims, the terms "general" or "generally", or "substantial" or "substantially" mean that the recited characteristic, angle, shape, state, structure, or value need not be achieved exactly, but that deviations or variations, including for example, tolerances, measurement error, measurement accuracy limitations and other factors known to those of skill in the art, may occur in amounts that do not preclude the effect the characteristic was intended to provide. For example, an object that has a "generally" cylindrical shape would mean that the object has either an exact cylindrical shape or a nearly exact cylindrical shape. In another example, an object that is "substantially" perpendicular to a surface would mean that the object is either exactly perpendicular to the surface or nearly exactly perpendicular to the surface, e.g., has a 5% deviation.

It is to be understood that terms such as "top", "bottom", "middle", "side", "length", "inner", "outer", "interior", "exterior", "outside", "vertical", "horizontal" and the like as may be used herein, merely describe points of reference and do not limit the present invention to any particular orientation or configuration. Further, terms such as "first," "second," "third," etc., merely identify one of a number of portions, components, and/or points of reference as disclosed herein and likewise do not limit the present invention to any particular configuration or orientation.

As used herein and in the claims, the term "straight" means substantially straight. As discussed with regard to "substantially" above, this means that the state of straight does not need to be achieved exactly, but some tolerances may occur in amounts that do not preclude the effect the characteristic was intended to provide.

Although the description referred to particular embodiments, the disclosure should not be construed as limited to the embodiments set forth herein.

EXAMPLES

Provided herein are examples that describe in more detail certain embodiments of the present disclosure. The examples provided herein are merely for illustrative purposes and are not meant to limit the scope of the invention in any way. All references given below and elsewhere in the present application are hereby included by reference.

Figure 1B:
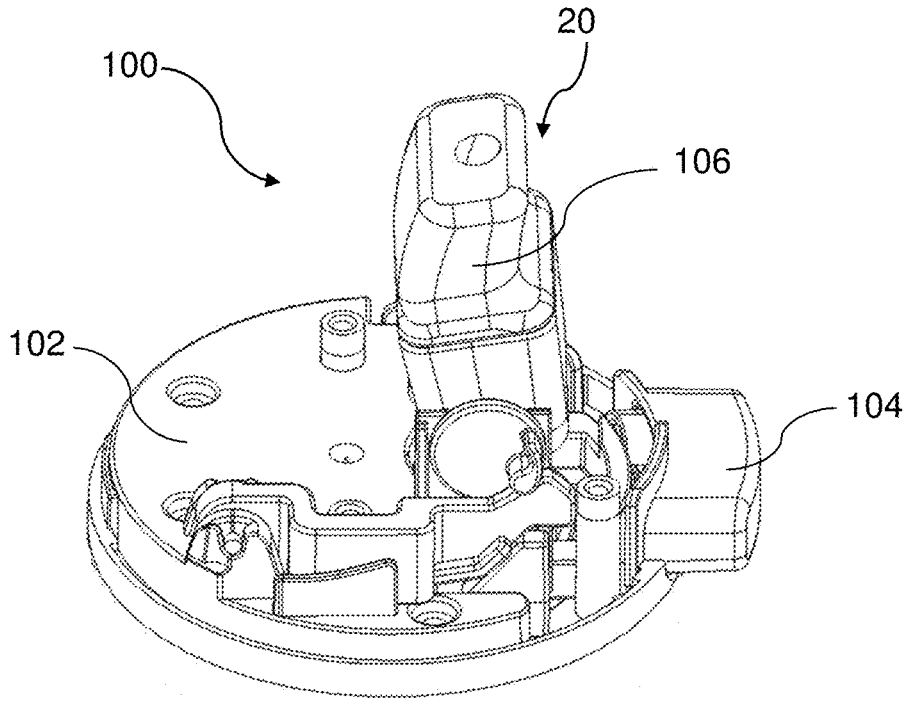
FIG. 1B is a perspective view of the lid assembly in the open configuration of the spout, according to an example embodiment.

FIG. 1A and FIG. 1B show the perspective views of a lid assembly 100 for a container. Herein, FIG. 1A shows the lid assembly 100 for a container in a closed configuration 10, while FIG. 1B shows the lid assembly 100 for a container in an open configuration 20.

The lid assembly 100 includes a frame 102, a lid button 104 and a spout 106. The frame 102 houses the spout 106 in two predefined configurations, i.e., the open configuration 20 and the closed configuration 10. The spout 106 of the lid assembly 100 is rotatably mounted on the frame 102. Moreover, the lid assembly 100 further comprises the lid button 104 mounted on the frame 102. The lid button 104 is configured to be pushed by a user and thereby receive an actuation force from the user. Further, the lid button 104 is configured to transmit the actuation force in a first direction. Herein, the first direction is defined as the direction of the push provided by the user on the lid button 104.

Figure 2:
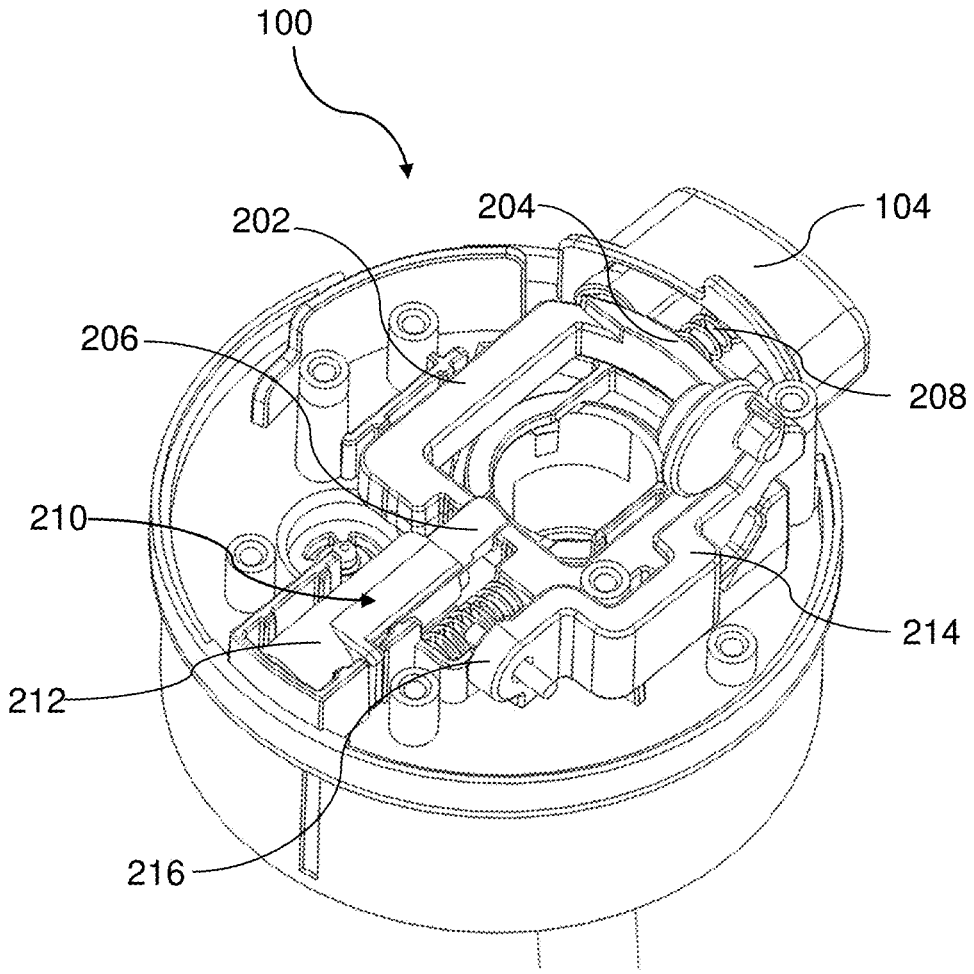
FIG. 2 is a perspective view of the lid assembly in the disengaged state of the retractable push-button mechanism, according to an example embodiment.

FIG. 2 shows the perspective view of the inside of the frame 102. The lid assembly 100 further includes a push member 202 mounted on the frame 102. Further, the push member 202 includes two ends associated with it. A first end 204 of the push member 202 is operatively coupled to the lid-button 104. Further, a button spring 208 is disposed in between the lid button 104 and the push member 202 such that the lid button 104 returns to its original position once pushed by the user. Furthermore, a second end 206 of the push member 202 is operatively coupled to a retractable push-button mechanism 210. The retractable push-button mechanism 210 includes a housing 212 which houses the retractable push-button mechanism 210 and the sub-components thereof (not shown in FIG. 2). The actuation force received on the lid button 104 by the user is transmitted to the push member 202 in the first direction. Further, the lid assembly 100 includes a guide member 214. The guide member 214 is housed within the frame 102 and operatively coupled to the push member 202. The hinge 216 allows the guide member 214 to move in a rotational direction.

Figure 3:
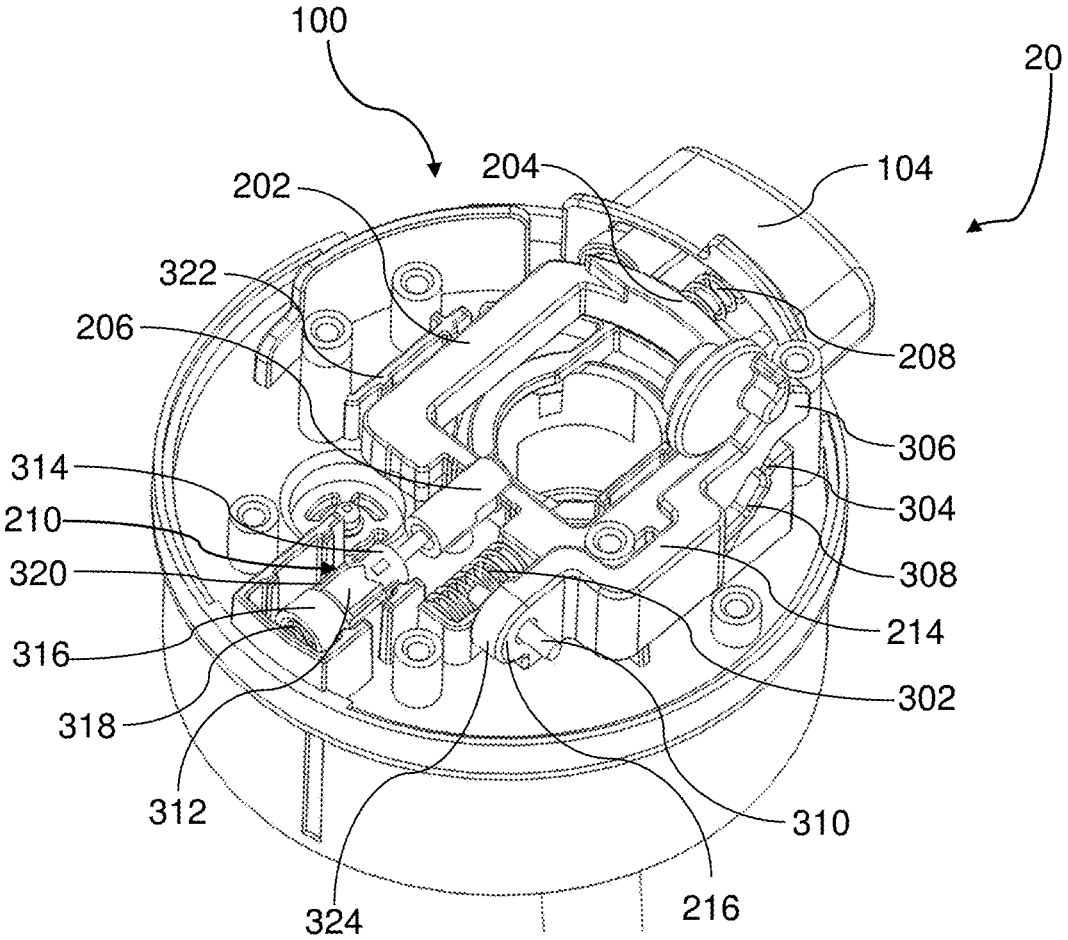
FIG. 3 is a perspective view of the lid assembly shown in FIG. 2, according to another example embodiment of the retractable push-button mechanism.

FIG. 3 shows the perspective view of the internal components of the lid assembly 100 for containers in the open configuration 20. Once the push member 202 receives the actuation force in the first direction from the lid button 104, the push member 202 transmits the actuation force to the retractable push-button mechanism 210 from the second end 206 of the push member 202. The lid assembly 100 further includes a biasing member 302, which is mounted between the frame 102 and the push member 202. The biasing member 302 is configured to absorb the actuation force. In the open configuration 20, the biasing member 302 is not compressed due to a lack of the actuation force received from the push member 202.

In some embodiments, the biasing member 302 may be a spring such that the spring is mounted in a way where the axis of the spring is in the direction of the force exerted by the user. In other embodiments, the biasing member 302 may be a gas or pneumatic Spring, bimetallic Strip, leaf Spring, magnetic spring, Shape Memory Alloy (SMA) wire or strip, elastic bands, etc., or a combination thereof.

In one embodiment, the frame 102 includes a partition 322 that confines the various components of the lid assembly 100 in a given area or volume. For example, the partition 322 around the push member 202 assists the push member 202 to move only in the first direction or the direction opposite to the first direction. Similarly, the retractable push-button mechanism 210 may be bounded by the partition 322.

Furthermore, the push member 202 includes a slide surface 304 having a predefined inclination angle with respect to the first direction such that the push member 202 can act as a wedge.

Furthermore, guide member 214 has the hinge end 324, a feeder end 306 and a guide surface 308. The hinge end 324 at one end of the guide member 214 may be removably and pivotally connected to the hinge 216 mounted on the frame 102 using a shaft 310. The guide surface 308 of the guide member 214 is formed such that the guide surface 308 corresponds to the shape of the slide surface 304 of the push member 202. In the open configuration 20, the angle of the guide surface 308 with respect to the first direction of the actuation force is the same as the inclination angle of the slide surface 304 with respect to the first direction of the actuation force. Since the guide member 214 is hinged at the hinge 216, the guide member 214 is configured to move in a rotational direction and direct the actuation force from the first direction to a second direction.

Moreover, the lid assembly 100 includes the retractable push-button mechanism 210. In one embodiment, the retractable push-button mechanism 210 includes the housing 212 (see FIG. 2), a ratchet 312, a retaining clip 314, a stopper 316 and a return spring 318. The retractable push-button mechanism 210 includes the ratchet 312 mounted between the retaining clip 314 and the stopper 316.

In one embodiment, the ratchet 312 of the retractable push-button mechanism 210 includes a guide rail 320 having angular tips formed on the outer surface of the ratchet 312. In one embodiment, the housing 212 of the retractable push-button mechanism 210 includes a guide slot (not shown) formed inside the inner surface of the housing 212. The angular tips of the guide rail 320 conform with the ends of guide slots inside the housing 212, such that when the ratchet 312 moves in the first direction, the guide rails slide along the guide slot, wherein the angular tips of the guide rails engage with the ends of the guide slots thereby making a rotational movement of the ratchet 312.

In one embodiment, the guide slot is a slotted or grooved structure that provides a guided path for the movement of the guide rail 320 of the ratchet 312.

The retractable push-button mechanism 210 further includes the retaining clip 314. The retaining clip 314 securely holds the ratchet 312. The retaining clip 314 engages with the corresponding features on the ratchet 312 and the housing 212 to prevent accidental retraction. In one embodiment, the retractable push-button mechanism 210 further includes the return spring 318 and the stopper 316.

Figure 4:
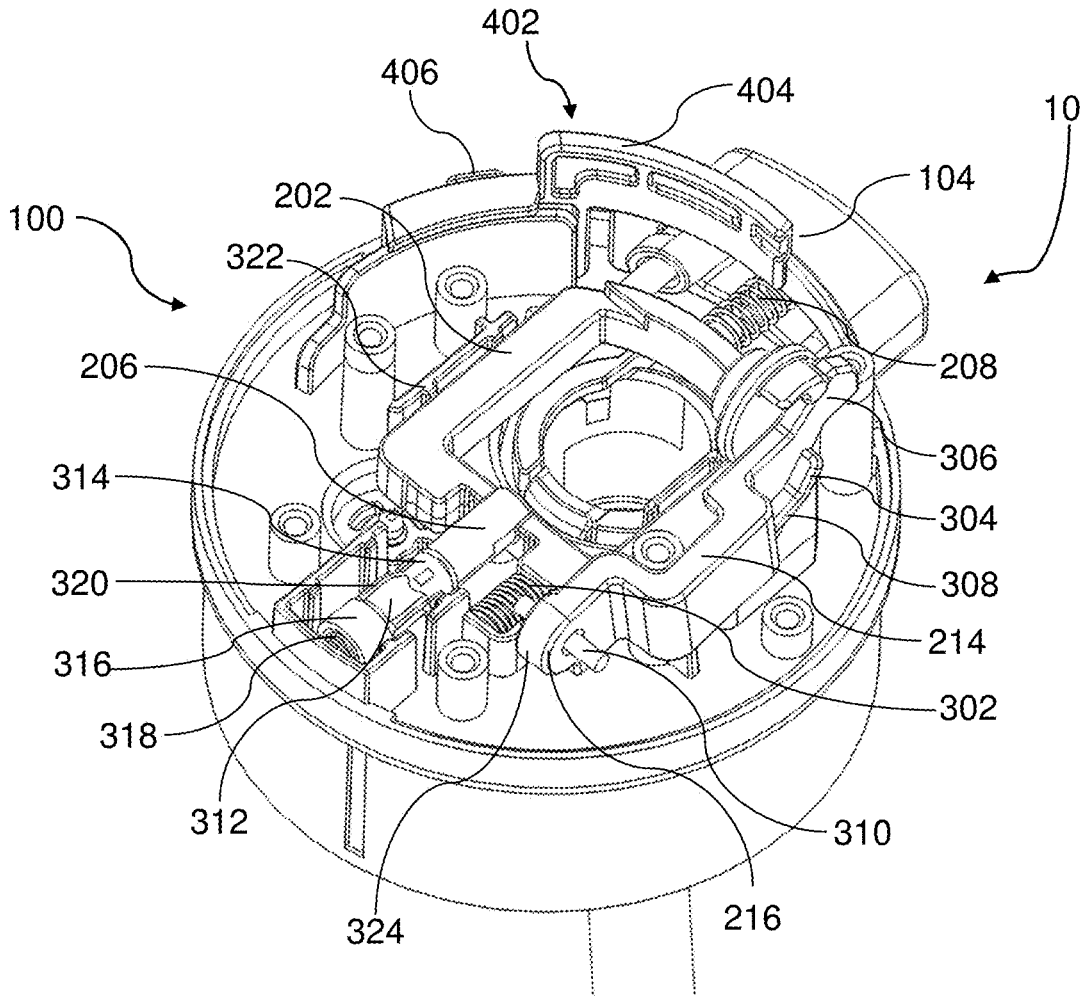
FIG. 4 is a perspective view of the lid assembly in the engaged state of the retractable push-button mechanism, according to an example embodiment.

FIG. 4 shows the perspective view of the internal components of the lid assembly 100 in the closed configuration 10. In the closed configuration 10, the biasing member 302 is compressed as the push member 202 is moved away from the lid button 104. The biasing member 302 is configured to push the push member 202 distally in a direction opposite to the first direction when the closed configuration is switched back to the open configuration. In the closed configuration, the guide member 214 is lifted by the hinge movement as the push member 212 pushes the guide member 214 in the second direction. In some embodiments, the second direction is defined as the rotational direction based on the pivotal movement of the guide member 214 such that the guide member 214 transmits the cam force to the rotary cam disc 502 (see FIG. 5A and FIG. 5B below).

Further, FIG. 4 shows the lid assembly 100 including a locking mechanism 402. Here the locking mechanism 402 includes a lock slider 404 having a toggle 406 protruding through a slot (not shown) on the frame 102. The toggle 406 may be used to slide the lock slider 404 to lock the lid button 104. The lock slider 404 blocks the movement of the lid button 104 by abutting against the lid button 104, thereby blocking the transmittal of the actuation force by the user. So, the user may slide the toggle 406 of the locking mechanism 402 to lock the lid button 104 in open configuration 20 of the spout 106. Alternatively, the user may slide the toggle 406 of the locking mechanism 402 to lock the lid button 104 in the closed configuration 10 of the spout 106.

In some embodiments, the retractable push-button mechanism 210 switches between the engaged state and the disengaged state. In the engaged state, the retractable push-button mechanism 210 holds the position of the push member 202 closer to the retractable push-button mechanism 210, thereby achieving the closed configuration of the spout. In the disengaged state, the retractable push-button mechanism 210 does not hold the position of the push member 202, so the biasing member 302 pushes back the push member 202 away from the retractable push-button mechanism 210, thereby achieving the open configuration of the spout.

In some embodiments, the retractable push-button mechanism 210 switches between the engaged state and the disengaged state whenever the retractable push-button mechanism 210 receives the actuation force from the second end 206 of the push member 202.

In some embodiment, the retractable push-button mechanism 210 includes, but is not limited to, a clicky pen mechanism, slide mechanism, toggle mechanism, twist mechanism, pull-cord mechanism, spring-loaded mechanism, or the like, or the combination thereof.

Figure 5A:
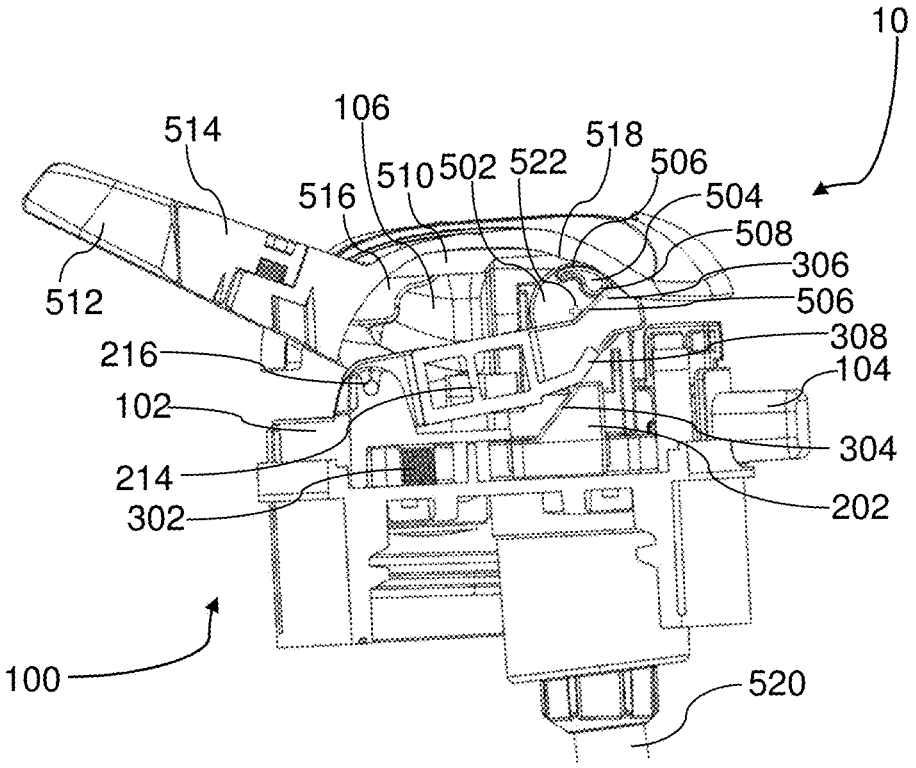
FIG. 5A is a sectional view of the lid assembly in the closed configuration of the spout, according to an example embodiment.
Figure 5B:
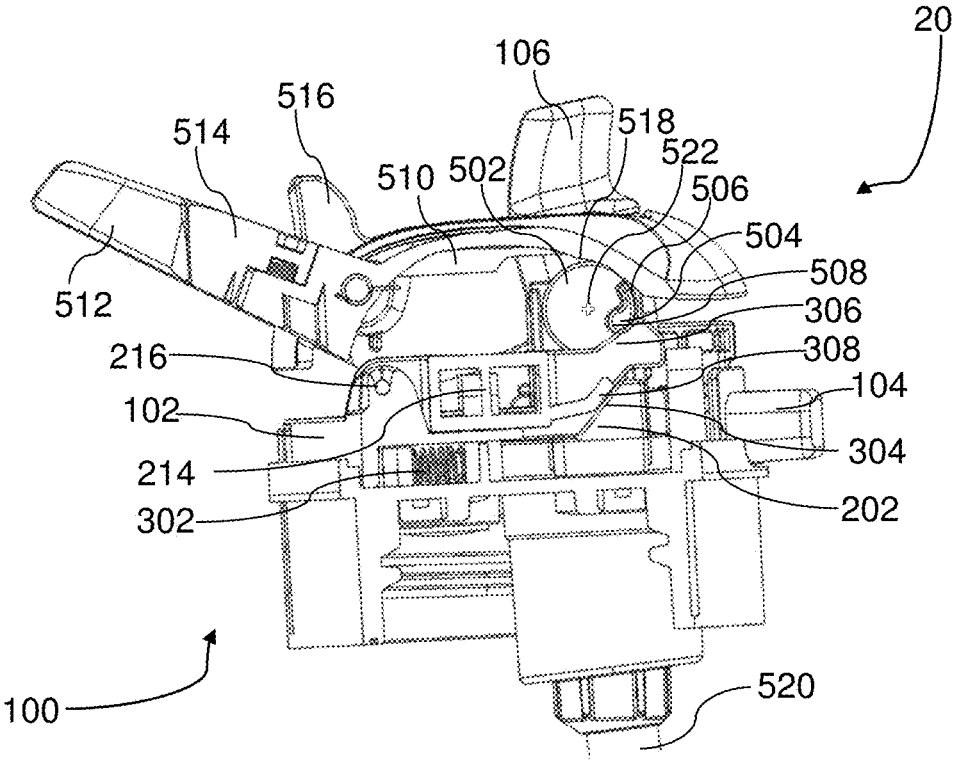
FIG. 5B is a sectional view of the lid assembly in the open configuration of the spout, according to an example embodiment.

FIG. 5A shows the sectional side view of the lid assembly 100 in the closed configuration 10, while FIG. 5B shows the sectional side view of the lid assembly 100 in the open configuration 20. The push member 202 having the slide surface 304 is mounted on the frame 102. The guide member 214 having the guide surface 308 and the feeder end 306 is also mounted on the frame 102 using the hinge 216. The rotary cam disc 502 has a protrusion 504 protruding from the surface of the rotary cam disc 502. The protrusion 504 includes a second curved surface 506 and a cam end 508. The feeder end 306 of the guide member 214 is in contact with a cam end 508 of the rotary cam disc 502. A lid cover 510 removably attached to the frame 102. In one embodiment, the lid cover 510 includes a handle 512 for gripping the bottle. The handle 512 may include a spring-loaded clip 514 for the purpose of hanging the container via the handle 512. Furthermore, the lid cover 510 includes a spout guard 516 for the purposes of covering the spout 106 for hygiene and cleanliness. The spout guard 516 may be closed in the closed configuration 10 and may be flipped upwards in the open configuration 20 as shown in FIG. 5B.

In some embodiments, the cam end 508 of the protrusion 504 may be formed as one of the shapes having at least a rounded profile such as, but not limited to, circular, eccentric, oval, elliptical, heart, snail, or the like, or a combination thereof.

FIG. 5A shows the closed configuration 10, where the guide member 214 is lifted by the hinge movement as the push member 202 transmits the actuation force in the first direction thereby directing the guide member 214 in the second direction. The biasing member 302 is compressed due to the actuation force in the first direction and the retractable push-button mechanism 210 (not shown in FIG. 5A) holding the position of the push member. As such, the feeder end 306 of the guide member 214 transmits the cam force to the cam end 508 of the protrusion 504 such that the rotary cam disc 502 and the spout 106 are rotated together around a cam axis 522, thereby achieving the closed configuration of the spout 106. The rotation of the rotary cam disc 502 is further guided by the curvature of the first curved surface 518 of the lid cover 510 and the second curved surface 506 of the protrusion 504.

FIG. 5B shows the open configuration 20, where the guide member 214 is not lifted by the hinge movement. As the retractable push-button mechanism 210 (not shown in FIG. 5B) does not hold the position of the push member 202 in the open configuration 20, the biasing member 302 is not compressed and the guide surface 308 of the guide member 214 sits on top of the slide surface 304 of the push member 202. The angle of the guide surface 308 of the guide member 214 with respect to the first direction conforms to the inclination angle of the slide surface 304 of the push member 202 with respect to the first direction. In the open configuration 20, the guide member 214 does not transmit the cam force to the cam end 508 of the protrusion 504 of the rotary cam disc 502 via the feeder end 306.

In some embodiments, when switching the lid assembly 100 from the open configuration 20 to the closed configuration 10, the lid button 104 is configured to receive the actuation force from the user. When the lid button 104 is pushed, the actuation force received by the lid button 104 is transmitted to the push member 202 in the first direction. In one embodiment, the first direction is the direction of the actuation force by the user. The button spring 208 between the lid button 104 and the push member 202 allows for the lid button 104 to retract to its original position after the actuation force has been transmitted to the push member 202. On receiving the actuation force from the lid button 104, the push member 202 is moved to the retractable push-button mechanism 210 in the first direction.

The movement of the push member 202 further directs the guide member 214 in the second direction by the hinge movement according to the inclination angle of the slide surface 304 of the push member 202. In one embodiment, the second direction is defined as the rotational direction based on the pivotal movement of the guide member 214 such that the guide member 214 transmits the cam force to the rotary cam disc 502.

The movement of the push member 202 in the first direction also causes the biasing member 302 to be compressed and the retractable push-button mechanism 210 to be in the engaged state. The engaged state of the retractable push-button mechanism 210 is configured to hold the position of the push member 202 such that the push member 202 is located closer to the retractable push-button mechanism 210 with the biasing member 302 compressed.

The movement of the guide member 214 in the second direction causes the transmittal of the cam force to the cam end 508 of the rotary cam disc 502. Since the rotary cam disc 502 is mounted on the frame 102 and is configured to rotate around the cam axis 522, the cam force in the second direction causes the rotary cam disc 502 to rotate. Further, since the rotary cam disc 502 is operatively coupled with the spout 106 and that the spout 106 and the rotary cam disc 502 rotate around the cam axis 522 together, the spout 106 is rotated to the closed configuration 10 accordingly.

In one embodiment, a soft tubing unit 520 is attached to the spout 106. The soft tubing unit 520 is configured to be collapsible and is adapted to be bent or collapsed when the soft tubing unit 520 is restrained in the closed configuration 10 of the spout 106.

In some embodiments, when switching the lid assembly 100 from the closed configuration 10 to the open configuration 20, the lid button 104 is also configured to receive the actuation force from the user. When the lid button 104 is pushed, the actuation force received by the lid button 104 is transmitted to the push member 202 in the first direction. The button spring 208 between the lid button 104 and the push member 202 allows for the lid button 104 to retract to its original position after the actuation force has been transmitted to the push member 202. On receiving the actuation force from the lid button 104, the push member 202 is moved further in the first direction. The further movement of the push member 202 in the first direction transmits the actuation force to the retractable push-button mechanism 210 and causes the retractable push-button mechanism 210 to be in the disengaged state. As such, the retractable push-button mechanism 210 does not hold the position of the push member 202, thereby releasing the push member 202 to return to its original position. The biasing member 302 pushes the push member 202 to its original position and becomes uncompressed.

In some embodiments, the soft tubing unit 520 is made of a resilient material such that the soft tubing unit is configured to be straight at rest such that the spout 106 and the soft tubing unit 520 automatically or elastically return to the open configuration from the closed configuration unless otherwise restrained.

In some embodiments, the coil or spring mechanism may be added to assist the returning of the spout 106 to the open configuration.

In some embodiments, the soft tubing unit 520 is made of resilient and/or flexible materials. The soft tubing unit 520 may be formed using, but not limited to, shape memory alloys (such as nitinol), elastomeric materials (such as rubber or silicon), composite structures (such as flexible polymer as the primary material and reinforced with embedded carbon fiber or metal wires), expandable structures (such as telescopic metal pipe with spring-loaded sections), or the like, or the combination thereof.

When switching the lid assembly 100 from the closed configuration 10 to the open configuration 20, the biasing member 302 pushes back the push member 202 to its original position. In one embodiment, due to the resilient characteristic of the soft tubing unit 520, the spout 106 and the soft tubing unit 520 automatically or elastically return to the open configuration from the closed configuration. As such, the cam end of the rotary cam disc 502 pushes back the feeder end 306 of the guide member 214, thereby causing the guide member 214 to return to its original position, where the guide surface 308 of the guide member 214 and the slide surface 304 of the push member 202 are fully in contact with each other.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

Devices discussed within different figures can be added to or exchanged with devices or methods in other figures. Further, specific data values (such as specific quantities, numbers, categories, etc.) or other specific information should be interpreted as illustrative for discussing example embodiments. Such specific information is not provided to limit example embodiment.

What is claimed is:

1. A lid assembly for a container comprising:

a frame;

a lid button configured to receive an actuation force thereto and transmit the actuation force in a first direction;

a push member having a first end, a second end and a slide surface having an inclination angle wherein the push member is operatively coupled to the lid button on the first end and configured to receive the actuation force in the first direction from the lid button;

a guide member having a guide surface and a feeder end wherein the guide surface and the slide surface are adapted to slide over each other such that when the push member receives the actuation force from the lid button, the push member drives the guide member towards a second direction according to the inclination angle and transmit a cam force in the second direction;

a spout configured to be operatively coupled to a rotary cam disc such that the spout and the rotary cam disc rotate together around a cam axis when the rotary cam disc receives the cam force in the second direction from the feeder end of the guide member; and a retractable push-button mechanism operatively coupled to the second end of the push member and configured to receive the actuation force in the first direction from the second end of the push member;

wherein the retractable push-button mechanism is configured to switch between an engaged state and a disengaged state upon receiving the actuation force in the first direction from the push member;

wherein in the disengaged state, the spout is configured to be in an open configuration, and in the engaged state, the spout is configured to be in a closed configuration.

2. The lid assembly of claim 1, wherein the lid assembly further comprises a lid cover having a first curved surface internally disposed on the lid cover; wherein the lid cover is removably attached to the frame.

3. The lid assembly of claim 2, wherein the rotary cam disc comprises a protrusion having:

a second curved surface; and a cam end;

wherein the cam end is configured to be operatively coupled to the feeder end of the guide member and receive the cam force in the second direction from the feeder end of the guide member.

4. The lid assembly of claim 3, wherein when the cam end of the protrusion receives the cam force in the second direction from the feeder end of the guide member, the rotary cam disc rotates around the cam axis guided by the first curved surface of the lid cover and the second curved surface of the protrusion.

5. The lid assembly of claim 2, wherein the guide member further comprises a hinge end configured to be pivotally connected to a hinge formed on the frame; wherein the hinge is configured to allow a pivotal movement of the guide member with respect to the frame such that the guide member transmits the cam force in the second direction.

6. The lid assembly of claim 1, wherein the spout comprises a soft tubing unit adapted to be bent when the soft tubing unit is restrained in the closed configuration, the soft tubing unit adapted to be straight in the open configuration.

7. The lid assembly of claim 6, wherein the soft tubing unit is made of a resilient material such that the soft tubing unit is configured to be straight at rest and automatically or elastically return to the open configuration from the closed configuration, unless otherwise restrained.

8. The lid assembly of claim 1, wherein the retractable push-button mechanism comprises a biasing member operatively coupled to the push member, wherein the biasing member is configured to be compressed when the biasing member receives the actuation force from the push member and the retractable push-button mechanism switches to the engaged state, wherein the biasing member is configured to push the push member distally in a direction opposite to the first direction and become uncompressed when the retractable push-button mechanism switches to the disengaged state.

9. The lid assembly of claim 1, wherein the retractable push-button mechanism holds a position of the push member when the retractable push-button mechanism is in the engaged state.

* * * * *